United States Patent [19]

Nair et al.

[11] Patent Number: 4,835,084

[45] Date of Patent: May 30, 1989

[54] ELECTROSTATOGRAPHIC TONER AND METHOD OF PRODUCING THE SAME

[75] Inventors: Mridula Nair, Penfield; Zona R. Pierce, Rochester, both of N.Y.

[73] Assignee: Eastman Kodak Company, Rochester, N.Y.

[21] Appl. No.: 171,066

[22] Filed: Mar. 21, 1988

[51] Int. Cl.[4] ..... G03G 9/08

[52] U.S. Cl. ..... 430/137; 524/366; 524/758; 528/494; 528/934

[58] Field of Search ..... 430/137; 524/366, 758; 528/494, 934; 252/DIG. 1

[56] References Cited

U.S. PATENT DOCUMENTS

| | | | |
|---|---|---|---|
| 2,886,559 | 5/1959 | Wiley | 260/91.7 |
| 2,932,629 | 4/1960 | Wiley | 260/91.7 |
| 2,967,857 | 1/1961 | Pfeifer et al. | 528/494 |
| 3,000,871 | 9/1961 | Engel | 528/494 |
| 3,045,002 | 7/1962 | Sommer | 528/494 |
| 3,258,453 | 6/1966 | Chi | 528/494 |
| 4,139,483 | 2/1979 | Williams et al. | 252/62.1 |
| 4,163,090 | 7/1979 | Wiley et al. | 526/88 |
| 4,198,477 | 4/1980 | Williams et al. | 430/120 |
| 4,314,932 | 2/1982 | Wakimoto et al. | 260/42.53 |
| 4,360,611 | 11/1982 | Wakimoto et al. | 523/216 |
| 4,415,644 | 11/1983 | Tamaki et al. | 430/106.6 |

FOREIGN PATENT DOCUMENTS

| | | | |
|---|---|---|---|
| 56-40840 | 4/1981 | Japan | 430/137 |

*Primary Examiner*—Paul R. Michl
*Assistant Examiner*—Jeffrey A. Lindeman
*Attorney, Agent, or Firm*—Robert A. Gerlach

[57] ABSTRACT

Suspension stabilizer particles are removed from the surface of polymer particles formed in a limiting coalescence formation technique by dissolving in a solution containing a fluoralkyl polyether surface active agent.

14 Claims, No Drawings

ELECTROSTATOGRAPHIC TONER AND METHOD OF PRODUCING THE SAME

FIELD OF THE INVENTION

This invention relates to polymeric particles and a method of preparing the same. More particularly, it relates to a method of preparing electrostatographic toner particles.

BACKGROUND OF THE INVENTION

Heretofore, it has been known to prepare particulate polymer particles by suspension polymerization a subset of which is limited coalescence. During the course of the process, coalescence of the oil (discontinuous phase) droplets in the aqueous (continuous) phase takes place to form larger size oil droplets. These droplets are limited in size by the presence of a suspension stabilizing agent present in the aqueous phase. This stabilizing agent prevents coalescence from taking place by what is generally believed to be a physical phenomenon that being the prevention (by separation) of one particle from wetting another and thereby joining together. U.S. Pat. Nos. 2,886,559; 2,932,629; and 4,163,090 are directed to techniques employing this limited coalescence form of suspension polymerization.

Suspension polymerization techniques are the subject of numerous patents dealing with the preparation of electrostatographic toner particles because these techniques generally result in the formation of toner particles having a substantially uniform size and uniform size distribution. U.S. Pat. Nos. 4,314,932; 4,360,611 and 4,415,644 are representative of suspension polymerization methods employed in toner manufacture.

A problem that occurs when employing suspension polymerization techniques in the preparation of electrostatographic toner particles is that inherently in the operation of this technique, a suspension stabilizer must be employed in the water phase to maintain the oil in water suspension of the monomer particles during the time they are polymerizing in the aqueous phase. Also, the suspension stabilizer is present to cover the surface of the droplets as polymerization proceeds in order to prevent coalescence. In the limited coalescence subset of suspension polymerization, the suspension stabilizing agent is present in an amount such that when the surface area of the suspension stabilizer matches the surface of the oil droplets, coalescence ceases and the particles will not continue to grow in size. Upon separation of thus formed polymer particles from the aqueous phase, the suspension stabilizing agent remains in place and must be removed in order to employ the polymer particles as electrostatographic toner. This is necessary because the presence of the stabilizing agent interferes with the tribo-electric relationship between the carrier particles and the toner particles employed as developers in electrostatographic devices.

Particulate suspension stabilizing agents, such as, silica or aluminum, are extremely difficult to remove from the surface of the polymer particle formed in the suspension polymerization process. Generally, these particles are removed by dissolving in a medium designed for this purpose. When the particulate stabilizing agent is silica, for example, the silica particles are removed from the surface of the polymer particles by dissolution in a strongly basic water solution, potassium hydroxide being generally preferred in this regard. During this operation, however, the polymer particles, particulaly the smaller size paticles, (those less than 6μm) tend to agglomerate and form clumps of particles which defeats the purpose of utilizing the limited coalescence polymerization procedure in the first place to achieve narrow size distribution. In order to prevent the agglomeration of the particles during the removal step of the suspension stabilization agent, it has been found necessary to incorporate in the alkaline solution a surface active agent. Unfortunately, the presence of surface active agents during this step of the process once again interferes with the charging characteristic of the resulting toner particles and in many instances renders the particles formed useless because they do not change properly in contact with the carrier particles required in the electrostatographic process.

SUMMARY OF THE INVENTION

The foregoing problem is overcome in accordance with this invention by forming a suspension of polymer particles in an aqueous phase having a layer of solid particulate suspension stabilizer on the surface of the polymer particles and separating the particulate suspension stabilizer from the polymer particles by washing in an aqueous alkaline solution in the presence of an amount of a fluoroalkyl polyether surface active agent sufficient to prevent the agglomeration of the particulate polymer particles freed of the particulate suspension stabilizer. By employing the specific surface active agents set forth above and defined hereinafter, the agglomeration of the particles is prevented during the removal step of the particulate suspension stabilizer and the resulting particles exhibit charging characteristics that render the particles suitable as electrostatographic toner particles.

DETAILED DESCRIPTION OF THE INVENTION

When particulate suspension stabilizer covers the surface of polymer particles as a result of the technique employed in the process of preparation of the polymer particles, it is required for certain applications of the particles, that the suspension stabilizer be removed. One particular application is electrostatographic toner. Particulate suspension stabilizer employed in the preparation of polymers include for example, silica, alumina, barium sulfate, calcium sulfate, barium carbonate, calcium, carbonate calcium phosphate and the like. Of these, silica is preferred.

These stabilizers are removed by dissolution by a material capable of achieving this result for the given particulate stabilizing agent. Suitable material include alkaline solutions such as, potassium hydroxide, sodium hydroxide, ammonium hydroxide and the like and acid solutions such as, hydrochloric acid, hydrofluoric acid, sulphuric acid, nitric acid and the like. In accordance with this invention the dissolution step is conducted in the presence of a fluoroalkyl polyether surface active agent.

By "fluoroalkyl polyether surface active agents" is meant, a surfactant containing totally fluorine substituted aliphatic moieties containing six to sixteen carbon atoms wherein the aliphatic moiety may contain mixtures of aliphatic chains varying from six to sixteen carbon atoms and a polyether moiety wherein the polyether chain varies from nine to fourteen ether linkages, and includes varying lengths of polyether linkages within the length of from nine to fourteen. The polyether moiety may include polyethylene or polypropylene segments. The fluoroalkyl polyether surface active agent may be a polymer containing both fluorinated hydrocarbon segments wherein all of the hydrogens have been replaced by fluorine and polyether segments wherein the alkyl chain of the polyether will be made up from either ethylene or propylene. Preferably, the fluoroalkyl polyether surface active agents are compounds or mixtures of compounds having the formula $$F(CF_2CF_2)_{3\text{-}8}—CH_2CH_2—O(CH_2CH_2O)_{9\text{-}13}$$

The most preferred fluoroalkyl polyether surface active agent is one sold under the name Zonyl FSN by duPont Company.

the fluoroalkyl polyether surface active agent is employed in an amount sufficient to prevent the agglomeration of the particulate polymer when freed of the particulate suspension stabilizer. It is preferred that minimum quantities of the surface active agent be employed to bring about this result in order to avoid any possible interference of the surface active agent with the charging characteristics of the toner for which the particles are to be used. The fluoroalkyl polyether surface active agent in most cases should be used in the amount from about 0.05 to about 5% by weight based on the weight of the aqueous solution containing the polymer particles and preferably in the amount of from about 0.2 to about 1% by weight.

The method employed in accordance with this invention for the preparation of toner particles encompasses the suspension polymerization technique wherein monomer particles contain all of the addenda necessary for use of the polymer particles as toner, including for example, various colorants, charge control agents and the like. The monomer or monomers containing the addenda are added to an aqueous medium containing a particulate suspension stabilizing agent and a promoter which drives the particulate suspension stabilizing agent to the surface of the monomer droplets. This mixture is agitated under heavy shearing forces in order to reduce the size of the droplets. During this time an equilibrium is reached and the size of the droplets is stabilized by the action of the suspension stabilizer coating the surface of the droplets. After polymerization is complete, thereby forming a suspension of polymer particles in an aqueous phase having a layer of solid particulate suspension stabilizer on the surface of the polymer particles, the procedure in accordance with this invention for removing this particulate suspension stabilizer from the surface of the droplets is employed.

In a second technique for forming polymer droplets in the aqueous phase, reference is made to copending U.S. application Ser. No. 171,065 entitled "Polymeric Powders" filed by Nair, Pierce and Sreekumar on even date herewith and assigned to the same assignee as this application, which is incorporated herein by reference. That application describes a process for dissolving a polymer in a solvent therefor which is immiscible with water thereby forming droplets in the continuous water phase when the system is subjected to high shear agitation. The polymer particles in the aqueous phase are coated with the particulate suspension stabilizing agent in the same manner as that described above for the suspension polymerization technique. The solvent is then driven off. Once again, the procedure in accordance with this invention is employed to separate the polymer particles for use subsequently as toner particles from the tightly adhering particulate suspension stabilizer.

In the suspension polymerization technique described generally above wherein polymerization takes place within the discontinuous droplets, any suitable monomer may be used in acordance with this invention such as, for example, styrene, p-chlorostyrene; vinyl naphthalene; ethylenically unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, N-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methylketone, vinyl hexyl ketone, methyl ispropyl ketone and the like; vinylidene halides such as vinylidene chloride, vinylidene chlorofluoride and the like; and N-vinyl compounds such as N-vinyl pyrrole, N-vinyl carbazole, N-vinyl indole, N-viny pyrrolidene and the like; and mixtures thereof. Mixtures of styrene and n-butylacrylate have been found to be particularly suitable monomers for use in the suspension polymerization technique of this invention.

If desired, a suitable pigment material may be used in the process of the invention to form colored particles. A pigment generally should be capable of being dispersed in a monomer, be insoluble in the water used in the polymerization processes and give strong, clear, permanent color. Typically of such pigments are carbon black, phthalocyanines, lithols, toluidine and inorganic pigment such as $TiO_2$. Typical of phthalocyanine pigments are copper phthalocyanine, mono-chlor copper phthalocyanine, hexadecachlor copper phthalocyanine, metal-free phthalocyanine, mono-chlor metal-free phthalocyanine, and hexadecachlor metal-free phthalocyanine; anthraquinone vat pigments such as: vat yellow 6 GL CI 1127, quinone yellow 18-1, indanthrone CI 1106,pyranthrone CI 1096; brominated pyranthrones such as: dibromopyranthrone, vat brilliant orange RK, anthrimide brown CI 1151, dibenzanthrone green CI 1101, flavanthrone yellow CI 1118; thinoindigo pigments such as: thioindigo red and pink EF; azo pigments such as: toluidine red CI 69 and hansa yellow; and metalized pigments such as: azo yellow (green gold) and permanent red. The carbon black may be of any of the known types such as channel black or furnace black. Dyes may also be utilized to provide a colored polymer particle.

If desired, any suitable chain transfer agents or crosslinking agent may be used in the suspension polymerization technique in accordance with this invention to modify the polymeric particle to produce particularly desired properties. Typical of crosslinking agents are aromatic divinyl compounds such as divinylbenzene, divinylnaphthalene or derivatives thereof; diethylenecarboxylate esters and amides such as diethyleneglycol methacrylate, diethylene glycol methacrylamide, diethyleneglycol acrylate; and other divinyl compounds such as divinyl sulfide or divinyl sulfone compounds.

Any catalyst or initiator which is soluble in the particular monomer or monomers being used may be utilized in the process of the invention. Typical of initiators for polymerization are the peroxide and azo initiators. Among those found suitable for use in the process of the invention are 2,2' azobis (2,4-dimethyl valeronitrile), lauroyl peroxide and the like which result in complete polymerization without leaving detrimental residual materials. Chain transfer and crosslinking agents may be added to the monomer to control the properties of the particle formed.

When a polymer or mixture of polymers is used as the starting material in accordance with the second technique indicated above, to prepare toner in accordance with this invention, any suitable polymer may be used such as, for example, olefin homopolymers and copolymers, such as polyethylene, polypropylene, polyisobutylene, and polyisopentylene; polyfluoroolefins, such as polytetrafluoroethylene and polyhexamethylene adipamide; polyhexamethylene sebacamide, and polycaprolactam; acrylic resins, such as polymethylmethacrylate, polyacrylonitrile, polymethylacrylate, polyethylmethacrylate, and styrene-methylmethacrylate; ethylene-methyl acrylate copolymers, ethylene-ethyl acrylate copolymers, ethylene-ethyl methacrylate copolymers, polystyrene and copolymers thereof with unsaturated monomers mentioned above, cellulose derivatives, such as cellulose acetate, cellulose acetate butyrate, cellulose propionate, cellulose acetate propionate, and ethyl cellulose; polyesters, such as polycarbonates; polyvinyl resins, such as polyvinyl chloride, copolymers of vinyl chloride and vinyl acetate, and polyvinyl butyral, polyvinyl alcohol, polyvinyl acetal, ethylene-vinyl acetate copolymers ethylene-vinyl alcohol copolymers, and ethylene-allyl copolymers, such as ethylene-allyl alcohol copolymers, ethylene-allyl acetone copolymers, ethylene-allyl benzene copolymers ethylene-allyl ether copolymers, and ethylene-acrylic copolymers; and polyoxymethylene, polycondensation polymers, such as, polyesters, polyurethanes, polyamides, polycarbonates and the like.

The invention is further illustrated by the following examples:

Preparation of Toner

Example 1

A concentrate was prepared by mixing on a two-roll mill equal parts of a cyan pigment of aluminum phthalocyan bridged by a siloxane moiety as described in U.S. Pat. No. 4,311,775, incorporated herein by reference and a styrene-acrylic addition copolymer sold under the name Pliolite AMAC by Goodyear.

Preparation of Monomer-Discontinuous Phase 192 grams of the above concentrate were dissolved by stirring overnight with 756 grams of styrene and 252 grams of butylacrylate. About 30 grams of 2,2'-azobis (2,4-dimethylvaleronitrile), a free radical initiator sold under the trade designation "Vazo 52" by duPont and about 4.8 grams of n-dodecanethiol as a chain transfer agent, (0.2% by weight based on the monomers).

Preparation of Aqueous-Continuous Phase

About 3600 mls. of water, about 48 mls. of a 50% weight suspension in water of silica particles having a particle size of20–25 nanometers and sold under the trade designation Ludox TM by the duPont Company, about 14.4 mls. of a 10% solution of poly(methylaminoethanol-co-adipic acid) and about 36 mls. of 2.5% by weight solution of potassium dichromate in water were mixed together and the pH adjusted to 4 by the addition of 1N HC1.

Particle Formation the monomer phase was added to the aqueous phase while stirring with a Polytron (sold by Brinkmann) mixer. This solution was filtered through a wet milk filter and then put through a Microfluidizer (Model No. 110 produced by Microfluidics Manufacturing) at 40 psi. The resulting monomer phase droplets had an average particle size of 5–7$\mu$m.

About 2400 mg. of this dispersion was placed in a round bottom three neck flask equipped with a condenser, paddle stirrer and ground glass stopper. The flask was maintained at a constant temperature of 50° C. and gently stirred. About 40 mg. of a charge control agent was added. Polymerization was continued for 17 hours, then the temperature was raised to 70° C. for 4 hours. The reaction product was collected on a medium frit filter funnel and washed once with water.

The filter cake was slurried in 6 liters of a 1NKOH aqueous solution to which 0.2% by weight of a fluoroalkyl polyether surface active agent which is a mixture of compounds having the formula $$F(CF_2CF_2)_{3\text{-}8}—CH_2CH_2—O(CH_2CH_2O)_{9\text{-}13}$$

sold under the trade designation Zonyl FSN by duPont Company for 17 hours. The particles were collected on a fritted funnel and divided into two equal parts. The first part was washed once with O.lN potassium hydroxide and then once with water until neutral pH, then dired on a tray under ambient conditions. The dried toner particles were classified at 10,750 RPM at an air flow of 44m$^3$/hr. on a TM 1 Alpine Model 100 MZR Classifier to break up agglomerates.

The second part was washed with 3000 liters of water 5 times, dried on a tray under ambient conditions.

In each case, greater than 90% of the resulting particles had a size less than 12$\mu$m and substantially no foaming was observed during the silica dissolution step of the procedure.

When no surfactant in accordance with this invention was employed, substantial foaming took place and large amounts of agglomeration of particles occurred which could not be broken up in the classifying step set forth above.

The toner particles washed once (designated hereinafter as TWI) and the toner particles washed 5times (designated hereinafter as TW5) were individually charged against a standard ferrite carrier coated with polyvinylidene fluoride as described in U.S. Pat. No. 4,546,060. The charge on the toner was as follows: the 2 second measurement is the toner that initially develops thus simulating the actual charge in a copier and the 2 minute measurement is the mean charge of all the toner developed.

| | Charge in m coulombs/gram | |
|---|---|---|
| | 2 seconds | 2 minutes |
| TW1 | 55.7 | 110.9 |
| TW5 | 64.0 | 99.8 |

Images were prepared using each of the toners TW1 and TW5 on a linear breadboard where the toner concentration employed was 8%, the carrier was that as described above and the photoconductor was a multiactive element as described in Example 1 of U.S. Pat. No. 4,578,334.

The resulting image, when the voltages employed were Vo=500(primary corona charge) and Vb=110 (brush lines voltage) were high density, sharp and of low background (low Dmin or fog). Transfer quality to paper was good.

What is claimed is:

1. In a process of preparing electrostatographic toner by forming a suspension of polymer particles in an aqueous phase having a layer of particulate suspension stabilizer on the surface of the polymer particles, the improvement which comprises separating the particulate suspension stabilizer from the surface of the polymer particles by dissolving the suspension stabilizer in a solution containing an amount of a fluoroalkyl polyether surface active agent sufficient to prevent the agglomeration of the polymer particles freed of particulate suspension stabilizer.

2. The process of claim 1 wherein the particulate suspension stabilizer is silica.

3. The process of claim 2 wherein the silica is dissolved in an aqueous alkaline solution having a pH of at least 12.

4. the process of claim 3 wherein the aqueous alkaline solution is KOH in water.

5. The process of claim 1 wherein subsequent to the removal of the particulate suspension stabilizer, the polymer particles are washed repeatedly with water.

6. The process of claim 2 wherein the silica suspension stabilizer has a particle size of 0.001μm to 1μm.

7. The process of claim 1 wherein the polymer particles having a layer of suspension stabilizer on the surface is formed by a suspension polymerization technique.

8. The process of claim 1 wherein the polymer particles having a layer suspension stabilizer on the surface is formed by agitating a polymer dissolved in a solvent therefor in water, said solvent being immiscible with water.

9. The process of claim 1 wherein the fluoralkyl polyether surface active agent is present in an amount of from about 0.05 to about 5% by weight of the polymer particle containing aqueous solution.

10. the process of claim 1 wherein the fluoroalkyl polyether surface active agent is present in an amount of from about 0.2 to about 1% by weight of the polymer particle containing aqueous solution.

11. The process of claim 1 wherein the fluoroalkyl polyether surface active agent is a mixture of compounds having the general formula $$F(CF_2CF_2)_{3-8}-CH_2-\overset{\overset{R}{|}}{CH}-O(CH_2\overset{\overset{R}{|}}{C}HO)_{9-13}$$

where R is hydrogen or methyl.

12. The process of claim 11 wherein R is hydrogen.

13. The process of claim 11 wherein the fluoroalkyl polyether surface active agent is present in an amount of from about 0.05 to about 5% by weight of the polymer particle containing aqueous solution.

14. The process of claim 11 wherein the fluoroalkyl polyester surface active agent is present in an amount of from about 0.2 to about 1% by weight of the polymer particle containing aqueous solution.

* * * * *